US007745712B2

(12) United States Patent
Dunnett

(10) Patent No.: US 7,745,712 B2
(45) Date of Patent: Jun. 29, 2010

(54) QUICK RELEASE FOR SNARE STRAINER AND BUTT END APPARATUS AND METHOD

(76) Inventor: Ronn Dunnett, 4587 57th Street, Delta, BC (CA) V4K 3E4

( * ) Notice: Subject to any disclaimer, the term of this patent is extended or adjusted under 35 U.S.C. 154(b) by 83 days.

(21) Appl. No.: 11/378,582

(22) Filed: Mar. 17, 2006

(65) Prior Publication Data

US 2006/0219084 A1 Oct. 5, 2006

Related U.S. Application Data

(60) Provisional application No. 60/663,080, filed on Mar. 18, 2005.

(51) Int. Cl.
*G10D 13/02* (2006.01)

(52) U.S. Cl. ..... 84/415; 84/411 R

(58) Field of Classification Search ..... 84/104, 84/168, 410, 411 R, 412, 413, 415, 453, 458, 84/454; D17/22, 99
See application file for complete search history.

(56) References Cited

U.S. PATENT DOCUMENTS

| | | | | |
|---|---|---|---|---|
| 1,104,373 | A | | 7/1914 | Meyer |
| 2,024,937 | A | | 12/1935 | Ludwig |
| 2,096,209 | A | | 10/1937 | Strupe |
| 2,621,554 | A | | 12/1952 | Way |
| 3,635,119 | A | | 1/1972 | Thompson |
| 3,865,003 | A | | 2/1975 | Della-Porta |
| 3,911,779 | A | | 10/1975 | Della-Porta |
| 3,981,220 | A | | 9/1976 | Clark |
| 4,079,657 | A | * | 3/1978 | Sobreira ..... 84/411 R |
| 4,138,920 | A | * | 2/1979 | Meador ..... 84/415 |
| 4,339,982 | A | * | 7/1982 | Hoshino ..... 84/415 |
| 5,107,742 | A | * | 4/1992 | Cummings et al. ..... 84/415 |
| 5,557,053 | A | * | 9/1996 | Nickel ..... 84/415 |
| 5,684,257 | A | | 11/1997 | Yanagisawa |
| 6,020,547 | A | * | 2/2000 | Chen ..... 84/415 |
| 6,093,877 | A | * | 7/2000 | Nickel ..... 84/415 |
| 6,846,978 | B2 | | 1/2005 | Dofrman et al. |
| 2002/0083817 | A1 | * | 7/2002 | Hoshino ..... 84/415 |
| 2004/0065185 | A1 | * | 4/2004 | Hagiwara ..... 84/413 |
| 2004/0168563 | A1 | * | 9/2004 | Dorfman et al. ..... 84/415 |
| 2005/0188818 | A1 | * | 9/2005 | Okamoto ..... 84/415 |
| 2005/0223875 | A1 | * | 10/2005 | Hagiwara et al. ..... 84/415 |

* cited by examiner

*Primary Examiner*—Jeffrey Donels
*Assistant Examiner*—Christopher Uhlir
(74) *Attorney, Agent, or Firm*—Michael F. Hughes; Hughes Law Firm, PLLC

(57) ABSTRACT

In the specification and drawing, a coupling is described and shown connecting a snare to a snare drum, the snare drum having a drum wall with a top edge and a bottom edge. The coupling connects a male section to a female section. The male section and female section interoperate in a vertical location between top edge and bottom edge of the snare drum wall. One of either the female section or male section is fixed to the drum wall in a radial direction and tangential direction. The other is fixed to said snare.

33 Claims, 10 Drawing Sheets

QUICK RELEASE FOR SNARE STRAINER AND BUTT END APPARATUS AND METHOD

RELATED APPLICATIONS

This application claims priority benefit of U.S. Ser. No. 60/663,080, filed Mar. 18, 2005.

DETAILED DESCRIPTION OF THE EMBODIMENTS

Many times drummers, during a musical set, will have to stop between performances to maintain their drums. One type of drum which requires a high degree of maintenance is the snare drum. To achieve the proper sound characteristics from the snare, it is useful to have attached to the snare itself a tensioning member or what is more commonly referred to as a straining device or snare drum strainer. These strainers have been used throughout the lifespan of snare drums. More recently, the strainers have begun to incorporate adjustable tensioning or straining components within the strainer to achieve various levels of strain and concurrent sound characteristics from the snare. Also, engaging and disengaging the snare is accomplished through the use of a quick release lever or was more commonly referred to as a throw off.

Figure 1:
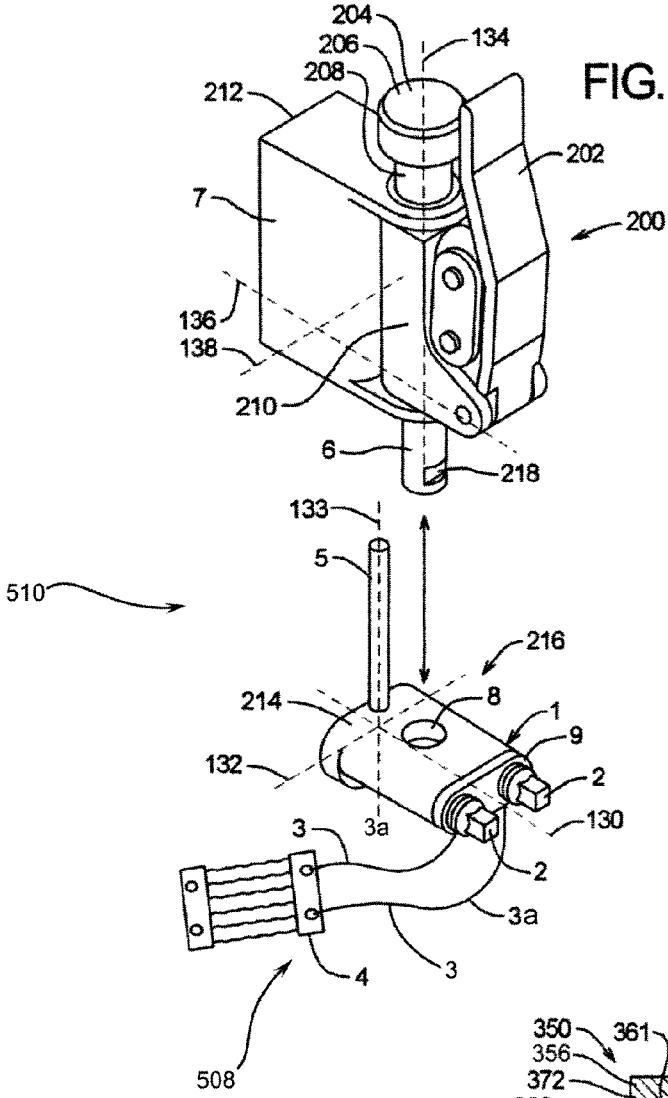
FIG. 1 is a perspective view of one embodiment showing the snare strainer body with the coupling detached from the main body of the snare strainer.

Referring to FIG. 1, a snare drum strainer 200 including the throw off lever arm 202, the straining adjustment mechanism 204, which in this particular embodiment has a top knob 206 connected to a circumferentially translating and vertically aligned shaft 208 placed within a shaft encasement body or vertically aligned receiving shaft 210, the circumferential shaft 208, has an inner threaded shaft not shown which threads into a receiving or connecting shaft 6. The connecting shaft 6 can act as a solid body or a male section, or it might act as a hollow shell or female section depending on the connection means with the below-mentioned snare attachment device. The strainer main body 7 in this embodiment is configured in a substantially rectilinear solid body with a back wall 212 which connects in some form to the drum wall structure 352 (FIG. 1A) and provides a rigid connection for tensioning the snare 508 as discussed below. The elements comprising a first end coupling mechanism 510 in one embodiment include the coupling mechanism 216, the connecting shaft 6, and the guide pin 5.

The connecting shaft 6 and the guide pin 5 are rigidly connected to the clamping body 214. In this present embodiment, the clamping body 214 acts as a female section, with an opening 8 to receive the present embodiment, male section or connecting shaft 6. The snare connection body 214 has within the main portion of the body in this embodiment, threaded pins which stick longitudinally out from the main portion of the body 214. The threaded pins engage a clamping plate 9 which closes over the first end 3*a* of the snare tensioning cord 3. The snare tensioning cord 3 is then held in place by a pair of key screws 2 which are tightened using a key screw key, not shown.

For maintenance or acoustical performance reasons, the drumhead may need to be replaced. This can be the batter drumhead or the snare drumhead depending on which one has deteriorated. Regardless, in order to disengage the drumhead from the drum, the musician must first detach the snare from the drum and then loosen the lugs to detach the drumhead.

Once the snare including wire set 4 and the snare tension cord 3 are connected to the clamping body 214, it is cumbersome to undo the key screws and loosen the clamping plate to remove the tensioning cord and disengage the snare wire set 4. In doing so, the pre-set tension set by adjusting the tension in the strainer using the top knob 206 is lost. Also, unscrewing the straining adjustment mechanism 204 from the connecting shaft 6, takes time and the desired pre-tensioning of the snare is undone. Before play, the musician will have to re-tension or re-strain the drum snare which will take time and is potentially inaccurate.

Thus the embodiments disclose a quick release coupling mechanism 216 for a snare drum strainer or at the butt end of the snare, so that the snare cord or clamping section of the strainer to which the snare wire is attached by the means of a strap or cord, can quickly fall away from the drum and quickly reattach to re-establish the preset strain of the snare.

This separation of the two main components, the snare connection body 214 and the snare strainer 200 or the butt end or semi-rigid drum wall connection to the cylindrical drum wall can be achieved through the use of various coupling mechanisms (coupler, coupling, coupling section) or quick release coupling mechanisms that can be used to achieve this result as discussed below.

Speaking broadly, the coupling mechanism incorporates within the snare connection body 214 a release trigger which interfaces with a portion of the connecting shaft 6. Another way of utilizing the coupling mechanism 15 would be to contain the mechanism within the connecting shaft 6 itself, and have a portion of the snare connection body 214 interface with a release trigger operated from for example, the top knob 206 of the connecting shaft 6 with a catch or some other component contained within the connecting shaft to interface with the clamping body portion. Additionally, the coupling mechanism 216 includes the use of a tongue and groove interface which slides the two connecting pieces together or apart and relies on frictional resistance forces between the two main bodies to provide fastening and resist sliding. Still another coupling mechanism uses a pivot pin or lever type system, and lastly a through shaft or cotter pin-type system can be used.

Referring back to FIG. 1, an embodiment of the release coupling mechanism 216 for a snare drum strainer as well as the butt end is shown including spring-loaded quick release button 10. The spring loaded mechanism can be any yielding type material with a resilient spring constant. One type of spring utilized is a coiled wire, another is an elastomeric material, and still another use of a yielding material is a tension wire.

The coupling mechanism in the current embodiment is contained within the snare connection body 214. The body 214 has an opening 8 which allows the connecting shaft 6 to be detachably removed and inserted into the opening 8. The couple in this instance occurs between the connecting shaft 6 which has a connecting notch 218 positioned at the lower vertical location of the shaft and interfaces with the spring-loaded button 10 as discussed below.

When coupled together with the shaft or male section 6, the body 214 is rotationally anchored to the snare strainer main portion 7 by a guide pin 5 which, in the current embodiment, is fixed to the top face of the body 214. The guide pin then is insertable into the body of the snare strainer 7 and parallels the vertical translation of the connecting shaft 6.

As previously mentioned, at the front portion of the body 214, the snare wire set 4 is attached by way of a snare tensioning cord 3. The snare tensioning cord 3 secures the snare wires 4 to the clamping device through the use of a pair of key screws which clamp the clamping plate 9 against the front face of the body 214.

Figure 1A:
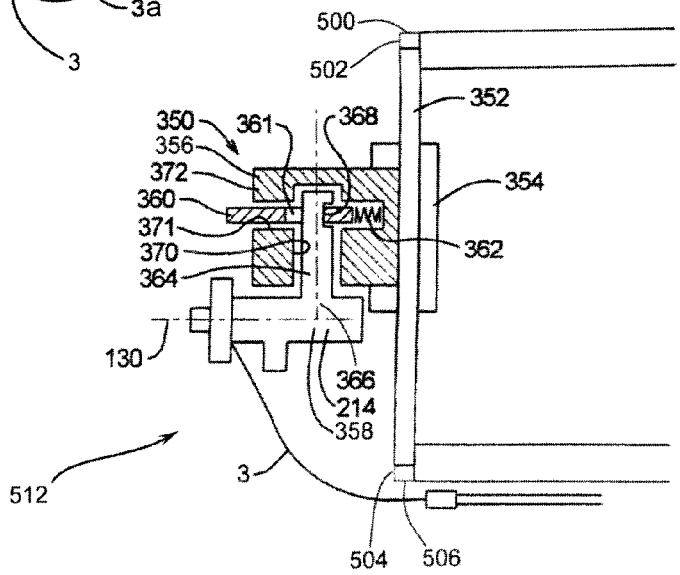

The snare connection body 214 is arranged along a longitudinally aligned axis 130, with a substantially perpendicular transverse axis 132 with a laterally aligned axis 133 substantially perpendicular to the transverse longitudinal plane. Similarly, the snare drum strainer 200 is arranged along a vertical axis 134 which parallels the cylindrical snare drum wall 352 and may be coupled to a coupling anchor 354 as seen in FIG. 1A. The snare drum also has a top edge 502, a bottom edge 504, a top hop 500, and a bottom hoop 506. The body 214 is also aligned with a radially aligned axis 136. The body 214 also is aligned along a tangential axis 138 which is substantially perpendicular to the radially aligned axis 136.

Referring to FIG. 1A, in order to provide a quick release coupling mechanism at the butt end of the snare, an alternative embodiment or second end coupling mechanism 512 is shown with a spring release coupling 350 having a female section 356 fixed to the drum wall 352 of the snare drum. The female section has a main body or receiving body 372 which has incorporated into its structure a receiving shaft 370. The receiving shaft 370 is substantially vertically aligned parallel to the drum wall 352. The receiving shaft 370 is parallel with the vertical axis 134 as previously mentioned in FIG. 1. The receiving body 372 extends perpendicularly from the drum wall 352 in a radically aligned direction 136 as previously mentioned similar to the snare strainer main body 7 (FIG. 1). A radially aligned slot 371 is also incorporated within the receiving body 372. Within this radially aligned slot is positioned a pushbutton catch 360. The pushbutton catch 360 is forced radially outwards to a resting position by a spring component 362. The spring component 362 sits in the rear portion of the radially aligned slot 371. The spring forces the pushbutton catch radially outwards to interoperate with the laterally aligned shaft 364 which is connected to the male section 358 of the snare connection body 214. As previously mentioned, the snare connection body 314 is arranged along a longitudinally aligned axis 130 which parallels the radially aligned axis when the male section 350 is connected to the female section 356.

Discussing the pushbutton catch 360, in this alternative embodiment, the pushbutton catch has a vertically aligned opening 361 in the center of the catch which aligns with the laterally aligned shaft 364 and the vertically aligned receiving shaft 370. The vertically aligned opening 361 in the pushbutton catch is forced radially outwards as previously discussed by the spring 362 to a resting position which is radially offset from the center line of the receiving shaft 370. When the user wishes to attach the male section 358 to the female section 356, the pushbutton catch 360 is pressed radially inwards depressing the spring component 362 and aligning the opening 361 with the receiving shaft 370. This allows the laterally aligned shaft 364 to be inserted vertically upwards through the opening 361 along axis 366. A notch or catch notch 360 within the laterally aligned shaft 364 mates with the rear portion of the pushbutton catch when the user removes its compressive force from the spring component 362 allowing the spring to force the pushbutton catch 360 radially outwards thus engaging the catch notch 368 and locking the male section 358 to the female section 356. In removing the male section 358, the user has just to depress the pushbutton catch 360 aligning the opening 361 with the receiving shaft 370 and allowing the male section 358 with the laterally aligned shaft 364 to drop out of engagement with the pushbutton catch 360. Referring back to FIGS. 2-5 of the first embodiment, as opposed to the male section being connected to the snare connection body 214, and the female section being connected to the drum wall 352, the roles are essentially reversed. Here the male section is essentially the notched connecting shaft 6, and the female section operates as part of the snare receiving body 214. The interior portion of the body 214 includes a quick release button 10 which is essentially a rectilinear body with an opening in the center of the body to allow for insertion of the notched connecting shaft 6, allowing it to be locked into place and connected to the clamping body 214 to complete the coupling mechanism 216.

The quick release button 10 is configured and arranged within a rectilinear slot, the button 10 having a top surface 60, and an equal but oppositely parallel bottom surface 62, with a height of the rectilinear body being the thickness of the button, the vertical height 220 providing enough material thickness to resist the shear forces which are applied to the body 214 and the notched connecting shaft 6 when the snare portion of the drum is strained to its desired capacity.

Figure 4:
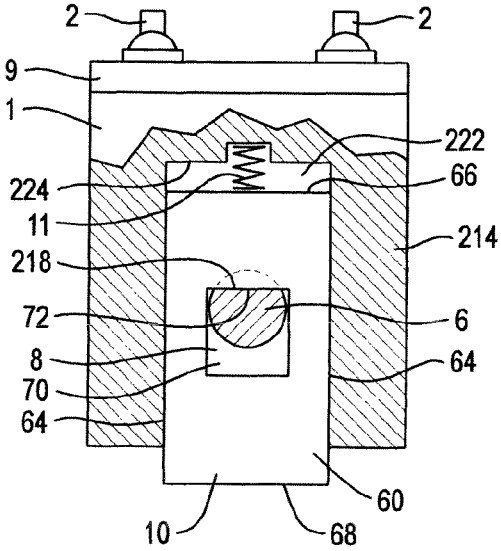
FIG. 4 is a top cross-section view of the coupling with the spring mechanism in the engaged position.

The quick release button 10, as seen in FIG. 4, fits within a buttoned cavity 222, which is slightly larger than the cross-sectional area of the quick release button 10 itself. Within the buttoned cavity 222 is positioned a spring 11, which acts to force the quick release button 10 longitudinally inwards towards the drum casing and thus engages the notched shaft 6.

This engagement between the quick release button contained in the body 214 and the notched shaft 6 is the coupling which transfers the tensioning restraining force from the strainer body 7 into the snare wires or snare wire set 4.

Figure 3:
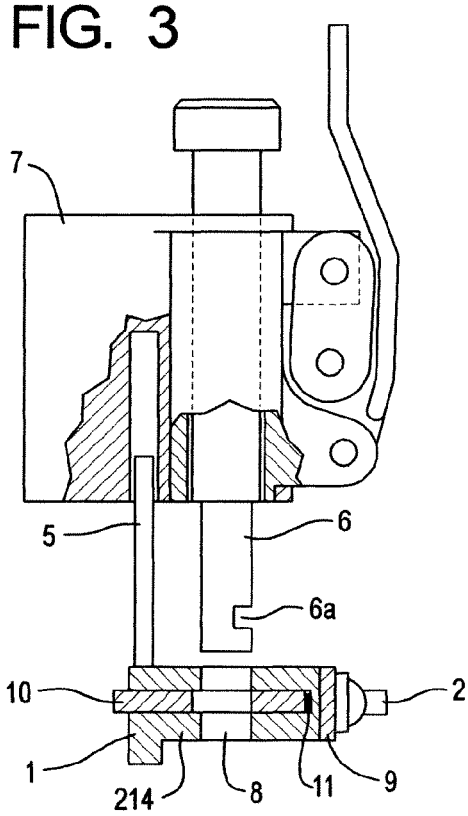
FIG. 3 is a profile cross-section view of the snare strainer with the coupling disengaged.
Figure 5:
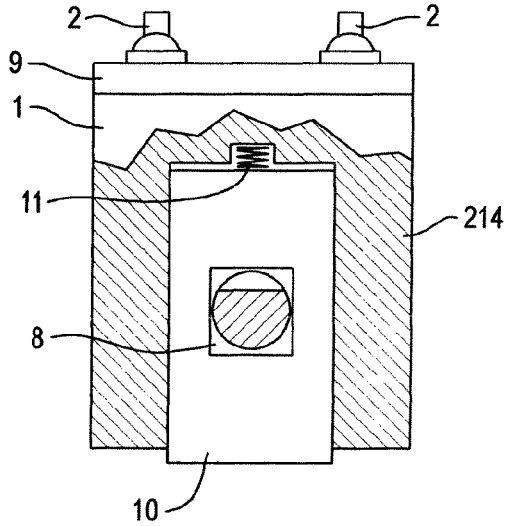
FIG. 5 is a top cross-section view of the coupling with the spring mechanism in the release position.

The male section or notched shaft 6 extends through the arched opening 70 positioned substantially in the middle of the release button 10. To disengage the release button 10 from the connecting notch 218 of the connecting shaft 6, the user can force the release button 10 towards the back wall 224 of the buttoned cavity 222 and compress the spring. The spring is compressed and the connecting shaft can be disengaged or decoupled from its locked or coupled position as seen in FIG. 4. FIGS. 3 and 5 disclose the removing of the connecting shaft 6 from the snare connecting body 214. The operation will be discussed in detail below.

In addition to the longitudinally aligned quick release button 10 as shown in FIGS. 2-5, other quick release buttons and quick release mechanisms can be used, for example: within the body 214 itself; at the interface between the connecting shaft 6 and the body 214; or within the interior of the connecting shaft 6. The following alternative embodiments disclose various configurations which can be utilized to quickly connect and/or couple, disconnect or decouple the snare connection body from the main portion of the strainer which is attached to the drum wall.

Figure 5A:
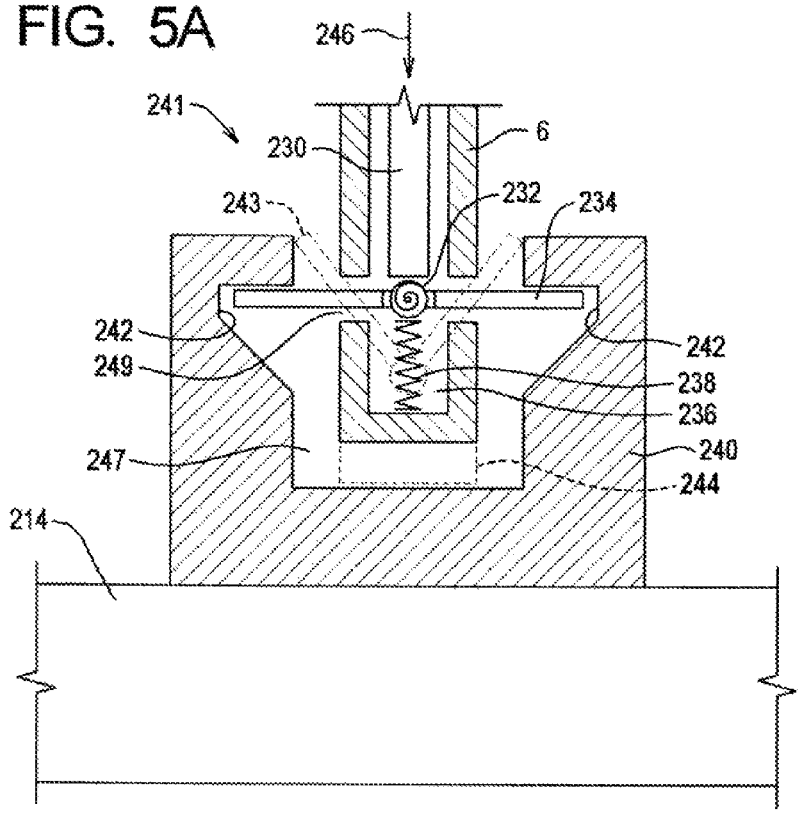
FIG. 5A is a cross-sectional elevational view of the connecting shaft spring-loaded quick release coupling mechanism.

Referring to FIG. 5A, a connecting shaft spring-loaded quick release coupling mechanism 241 is disclosed. This is another form of the coupling mechanism 216 (FIG. 1). This connecting shaft spring-loaded quick release coupling mechanism in the current embodiment uses a vertically aligned pushbutton shaft 230 which protrudes vertically along the connecting shaft 6 up through the top knob 206 (not shown), to disengage or decouple the connecting shaft 6 from the snare body 214. The connecting shaft 6 in this current embodiment is provided with a loaded circular spring 232 which has two radially protruding locking arms 234 positioned within locking arm port 249 which extend outside of the connecting shaft 6 and interface or couple with a snare body shaft locking collar 240. The loaded circular spring 232 has a torsionally resistant limit which enables the locking arms 234 to form a rigid bar throughout the radial direction and transfer the shear forces from the connecting shaft 6 through the locking arms 234 and into the body of the shaft locking collar 240. The locking arms 234 interface with the shaft locking collar 240 which has a pair of equal but opposite locking arm recesses 242.

The male section for this particular embodiment is the radially aligned locking arms 234 which interface with the female section or the shaft locking collar arm recesses 242.

When the user wishes to disengage the snare connecting body 214 from the connecting shaft 6, he presses the vertically aligned pushbutton shaft 230 which forces the circular spring-loaded locking bar 232 vertically downwards and compresses the connecting shaft lock spring 238 towards its encasement or spring recess 236. The locking arms 234 rotate to an angular locking arm position 243 which decouples the mechanism or enables the connecting shaft 6 to drop to a disengagement position 244 and once in this position enables the locking arms 234 to slide out of the locking arm recess 242. Once the locking arms are removed from the recesses, the connecting shaft 6 can be moved out of the interior portion 247 of the shaft locking collar 240.

Figure 5B:
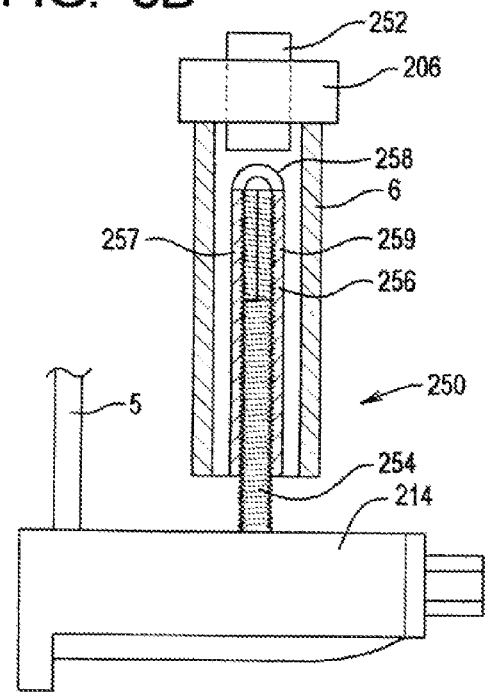
FIG. 5B is a cross-sectional elevational view of the clamping shaft spring-loaded quick release coupling mechanism.
Figure 5C:
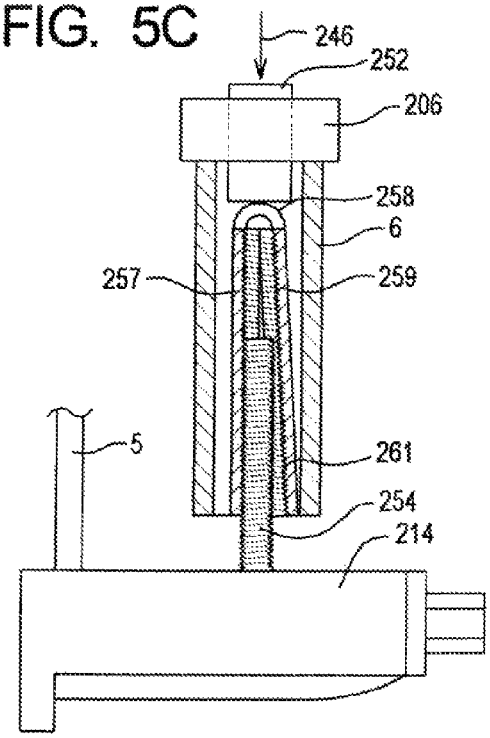
FIG. 5C is a cross-sectional elevational view of the clamping shaft spring-loaded quick release coupling mechanism in its decoupled position.

Along a similar vein, FIGS. 5B and 5C disclose the operation and structure of a clamping shaft spring quick release coupling mechanism 250. The general idea is to engage or couple and disengage or decouple the threaded casings 256 from the threaded shaft 254 which is permanently attached to the snare connection body 214. To accomplish this, the threaded casing 256 is operable within the connecting shaft 6 and can move along an angular plane to detach from the threads of the threaded shaft 254. The threaded casing 256 is made of two semi-cylindrical shafts which complete the casing, they include a rigid shaft 257 and a movable shaft 259. A clamping spring 258 holds the movable shaft 259 to the rigid shaft 257. The connecting shaft 6 has a top knob 206 which has integrated within its central body a pushbutton 252. The pushbutton 252 is movable along the vertical axis.

To disengage the snare connection body 214 and the threaded shaft 254 from the connecting shaft 6 and the rest of the strainer body 7, the user can press the pushbutton 252 with an adequate disengagement force 246. As the force compresses the clamping spring 258 the rigid shaft 257 stays substantially in its same location and the movable shaft 259 pivots about the origin of its connection which is at the clamping spring location 258. The movable shaft threads 261 disengage from the threaded shaft 254 enough to allow the user to pull the threaded shaft 254 away from the strainer.

In addition to connecting the two members of the coupling mechanism along the vertical translational axis, the two coupling members can be connected along the radial axis perpendicular to the vertical.

Figure 5D:
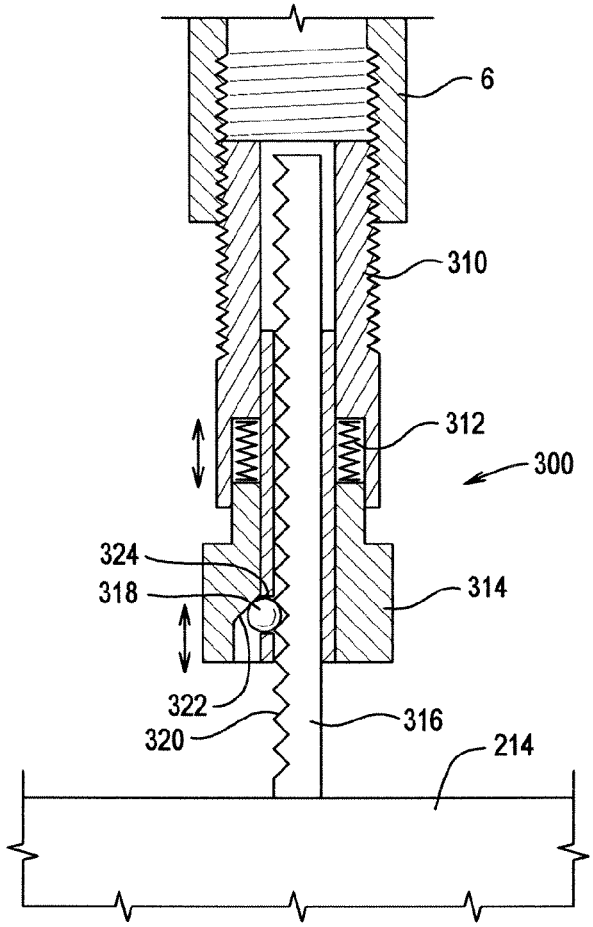
FIG. 5D is a cross-sectional elevational view of the spring-loaded bearing coupling mechanism in its coupled position.

Now referring to FIG. 5D, still discussing the coupling mechanism using a quick release spring-loaded type of apparatus or couple, the spring-loaded bearing coupling mechanism 300 has a vertically aligned intermediate threaded connecting shaft 310. This threaded connecting shaft 310 has an outer surface with threads which can be fitted to the strainer shaft or connecting shaft 6.

The interior of the intermediate threaded connecting shaft 310 has enough interior space to allow an anchor shaft 316, which is laterally connected to the snare connection body 214 but allowed to rotate rotationally about the lateral axis 133. The anchor shaft 316 has laterally spaced bearing seats 320, which are generally trapezoidal in shape and provide a recess for the spherical bearing 318 to fit into and lock the anchor shaft 316 into a vertical position when forced into the bearing seat 320. To vertically lock into place the anchor shaft 316, a bearing wedge locking collar 314 is provided which is configured as a cylindrical locking collar having vertical translational movement and is forced downwards by a plurality of wedge springs 312 positioned within the threaded connecting shaft 310. The locking collar 314 has a recess 324 which enables the bearing 318 to be substantially contained therein and locking collar has a bearing wedge 322. When the wedge spring 312 forces the locking collar 314 downwards in this particular alignment, the bearing wedge 322 transmits the vertical force component into a horizontal longitudinal force component thus pressing the vertical bearing 318 into the bearing seat 320. By providing this longitudinal force, the anchor shaft 316 cannot rotate nor move the spherical bearing 318 and fall away from the threaded connecting shaft 310. When the user presses a greater force than the wedge springs 312 upwards on the locking collar 314, the bearing 318 is disengaged from the bearing seat 320 and the anchor shaft can then apply a horizontal force to the outer surface of the spherical bearing 318, thus forcing it longitudinally inwards towards the bearing wedge space and allowing the anchor shaft 316 enough room to translate out of the threaded connecting shaft 310. Thus the engagement between the locking collar 314 and the anchor shaft 316 is broken and anchor body 214 can fall away from the strainer shaft or the connecting shaft 6.

Figure 6:
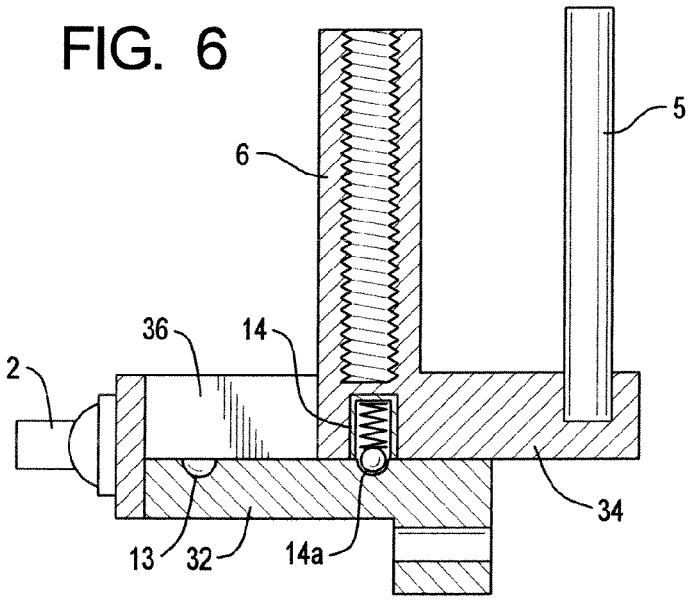
FIG. 6 is a cross-section of the dovetail or tongue and groove quick release coupling mechanism.

FIG. 6 is a profile cross-section of an embodiment of the coupling mechanism 216 that uses a sliding dovetail or tongue and groove couple connection. In this embodiment, the unit is divided into two sections shown partially disengaged, each of which feature (either male or female) tongue and groove interconnecting surfaces 16 allow the two sections to slide apart. The first half is comprised of the key screws 2 which, as previously mentioned, thread into the snare connection body 214 and hold the clamping plate 9 against the body. Thus the snare cord 3, which in turn is attached to the snare wire set 4, is secured. The second upper half consists of the shaft 6 which is embedded in this particular embodiment in the upper male body or tongue portion 34. The guide pin 5 is also embedded in this tongue portion. At the bottom surface of the tongue portion 34 is a bullet catch 14 which extends vertically downwards. The connection body 214 contains the female tapered edge or groove portion 36. At the upwardly facing bottom surface of this groove portion 36 is a semispherical socket 13 into which the spring-loaded bullet catch 14 will fit when the male tongue portion 34 is connected to the female tapered groove portion 36. With the bullet catch 14 extending into the semispherical socket 13 any natural sliding action which would take place between the two halves from playing of the drum is kept to a minimum because of the bullet catch spring.

Figure 7:
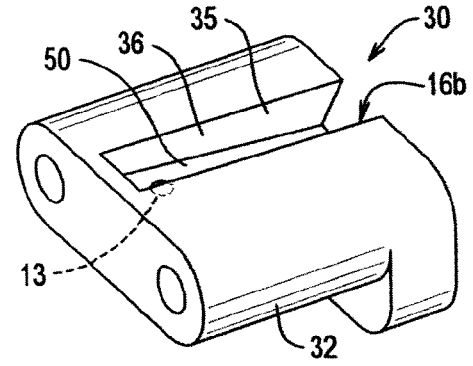
FIG. 7 is a bottom perspective view of the dovetail or tongue and groove quick release coupling mechanism in detached form.
Figure 8:
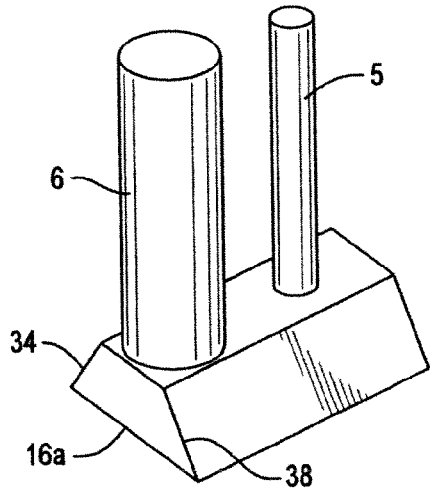
FIG. 8 is a top perspective view of the dovetail or tongue and groove quick release coupling mechanism in detached form.

FIGS. 7 and 8 are respective views of an embodiment of the snare strainer that uses a sliding dovetail or tongue and groove connection. The connection in cross-section can include a trapezoidal male and female receiving and protruding sections as well as a T-bracket cross-section which has more of a curvilinear profile.

In this embodiment, the coupling mechanism 216 is divided into two sections shown separated, each of which feature either male or female tongue and groove interconnecting surface 16 that allow the two sections to slide apart.

The female lower body 32 as previously mentioned in FIG. 6 has a longitudinally aligned groove section which has tapered sidewalls 36 and an upwardly facing bottom surface 50. Within the groove portion 35 is the previously mentioned semispherical socket 13. The groove portion has a transversely aligned cross-sectional area shaped as a trapezoid. This trapezoidal shape has a wider base surface which is bottom surface 50, and narrowing tapered side walls 36. The top wall is left open for interconnection with the male tongue portion 34. The male portion 34 is a solid body trapezoidal shaped section which is configured to accept the female groove portion 35. As previously mentioned and not shown in FIG. 8 is the bullet catch 14 positioned at the bottom surface of the male portion 34.

Figure 2:
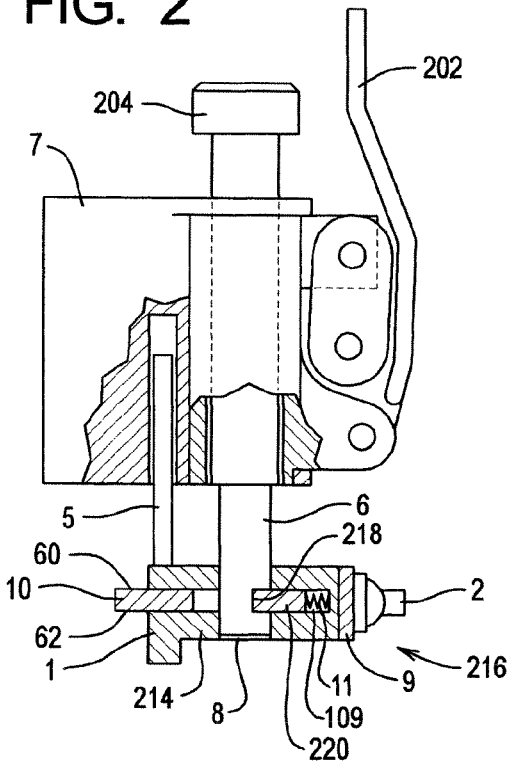
FIG. 2 is a profile cross-section view of the snare strainer with the coupling engaged.

Now discussing the mechanical operation of the first embodiment, and referring to FIG. 1, the snare attachment clamping device 1 or the spring-loaded release pushbutton coupling mechanism 216 is shown detached from the main body of the snare strainer 7. To couple the two parts together or make the connection from the snare strainer main body 7 to the snare attachment clamping device 1 or the body 214 using the spring-loaded pushbutton 10, the user will align the notched connecting shaft 6 with the opening 8 and insert the shaft 6 into the opening 8. To engage or couple the two parts together, in this embodiment the user (as seen in FIG. 2) will need to depress the quick release button 10 located at the longitudinally rearward position of the snare attachment clamping device 1 or the body 214.

Referring to FIGS. 2-5, the quick release button 10 in the current embodiment as previously discussed is configured as a rectilinear plate having a thickness with a top surface 60, a bottom surface 62, a parallel longitudinally aligned side surface 64, a forward surface 66, and a rearward surface 60. Additionally, the quick release button has an arched opening 70 allowing the notched connecting shaft 6 to fit into the arched opening 70 and travel vertically through the opening. The button 10 fits within the body of the snare connection device, where the device has a receiving section 10A or a slot 10A, configured to allow the quick release button to translate or move in the longitudinal direction forward and rearward as required to engage, couple, and disengage or decouple, with the notched connecting shaft 6.

Movement is provided by the user compressing the quick release button 10 against a spring-loaded mechanism 11 positioned forward of the front surface location 66 of the quick release button 10. The spring 11 is located within the receiving section 10A of the snare clamping device 1 or the coupling mechanism 216. In its connected state, or in other words in its coupled state, the snare strainer body 7 is attached to the snare clamping device 1 or the body 214, when the notched connecting shaft 6 travels vertically down through the arched opening 70 of the quick release button 10 and the spring-loaded mechanism 11 forces the engaging surface 72 of the arched opening 70 into the notched section 6A of the connecting shaft 6, thus creating the coupling connection between the snare strainer main body 7 and the body 214.

The user can disengage or decouple the body 214 or the snare clamping device 1 from the main body of the strainer 7 by depressing the quick release button 10 which moves the engaging surface 72 of the quick release button 10 out of connection with the notched section 6A of the connecting shaft 6. The user can then disengage and remove the body 214 from its coupled or locked state with the snare strainer 7 thus destressing or destraining the snare wire set 4 and allowing the musician to change the drum head.

An alternative operational embodiment is shown in FIGS. 7-10. In this alternative embodiment, a quick release coupling mechanism is shown where the coupling mechanism 216 is dissected into two main bodies. The first body is a female lower body 32 and the second main portion is the male upper body 34. The female lower body 32 has a tapered female receiving surface 16B which is configured to receive or couple with the tapered male surface 16A. The tapered male body 34 is connected to the threaded connecting shaft 6, as well as the guide pin 5 similar to the current embodiment shown in FIGS. 1-5. The female lower body 32 as discussed previously has a female receiving surface 16B which has a female tapered edge 36. This female tapered edge 36 is configured such that when the male surface or male body 34 is slidably fit in the longitudinal direction into the female surface section 16B, the pull of gravity on the female body 32 downwards is resisted by the female's tapered edge 36 pressing against the male tapered edge 38.

Referring to FIG. 6, just below the threaded connecting shaft 6 is positioned within the body of the male section 34 a bullet catch 14. In this current embodiment, the bullet catch is a spring-loaded mechanism pressing the bullet catch ball bearing 14A down into a semi-spherical socket 13.

The semi-spherical socket 13 is positioned within the lower upwardly facing horizontal surface 50 of the female's tapered edge.

As the tapered portion of the male upper body 34 is inserted into the tapered receiving section of the female lower body 32, the bullet catch 14 will lock the two sections together when the bullet catch ball bearing 14A is depressed by the spring into the semi-spherical socket 13 of the female lower body 32. The fixation occurs and any longitudinal translation is resisted by this increase in surface friction between the two main bodies. The user can then pull the two main bodies apart by applying a force greater than the frictional resistance of the bullet catch against the semi-spherical socket 13.

Figure 8A:
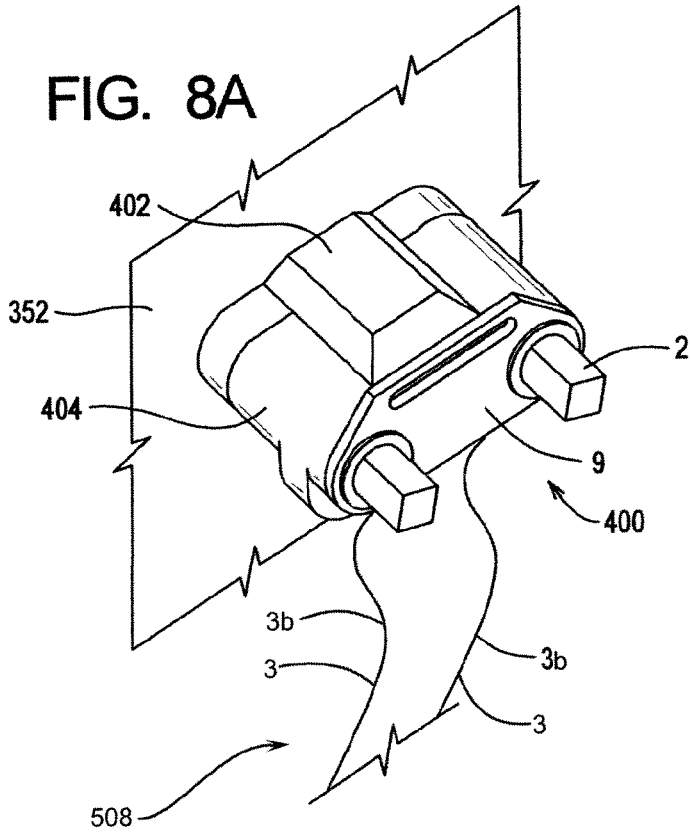
FIG. 8A is a top perspective view of a seated or tongue and groove coupling at the butt end.

Referring to FIG. 8A, a seated coupling at the butt end of the snare 508 will now be discussed. The seated coupling at butt end 400 is composed of two main sections. The first is a male section 402, and the second is a female section 404. The male section 402 is secured to the outside face of the drum wall 352. The female section 404 is operatively attached and detachable from the male section 402 as will be discussed. Also the female section is the snare connection body 214 which connects the cord clamping plate 9 to the coupling mechanism 400. Two key screws 2 are provided to secure second end 3*b* of the cord 3 to the coupling at the butt end.

Figure 8B:
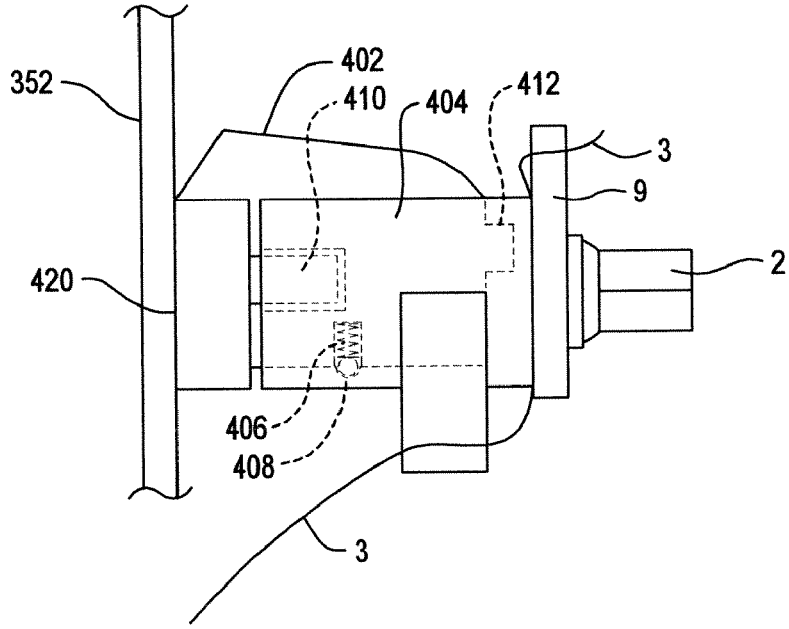
FIG. 8B is a side elevational view of the seated or tongue and groove coupling at butt end.
Figure 8C:
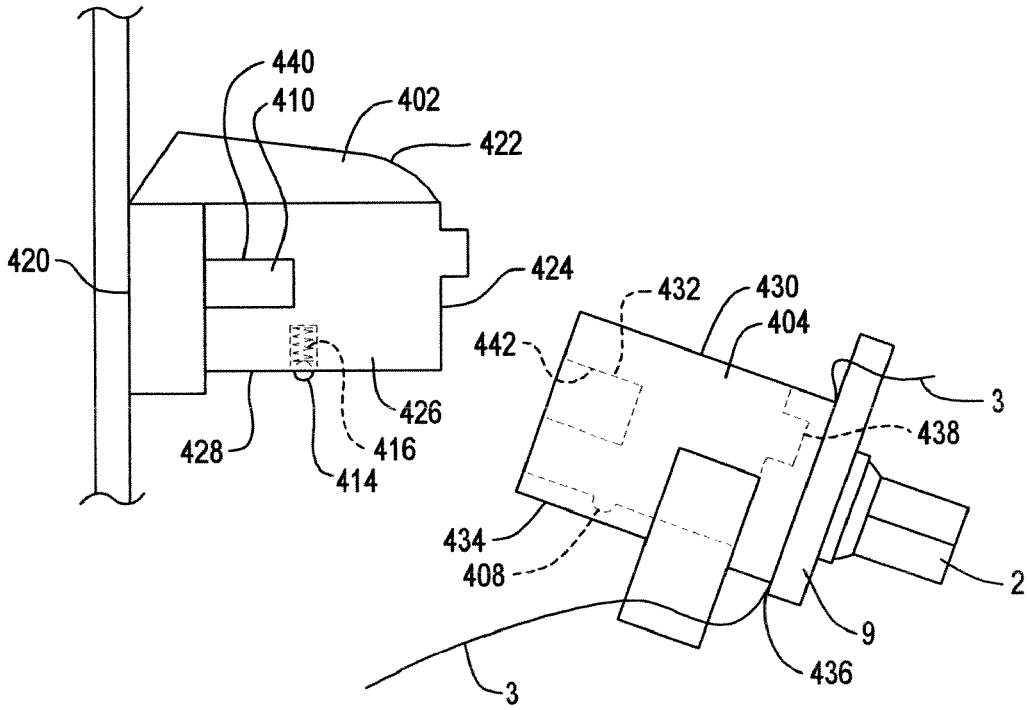
FIG. 8C is a side elevational view of the female section detached from the male section of the seated or tongue and groove coupling at butt end.
Figure 9:
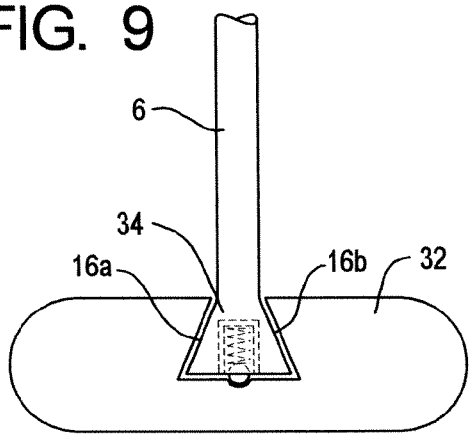
FIG. 9 is a cross-sectional view of the dovetail or tongue and groove quick release coupling mechanism showing bullet catch.

Referring now to FIGS. 8B and 8C, to provide for a secure seated connection between the male section 402 and the female section 404, the male section has two equal but oppositely aligned tangentially protruding seats 410 as well as a radially aligned male section front seat 412. The male section is connected to the drum wall 352 at the back wall 420. The male section has a top wall 422, a front wall 424, two parallel equal but opposite side walls 426 as well as a bottom wall 428. The female section has a top wall 430, and a front wall 436. The male section itself is a solid body construction in the current embodiment as a cast die type of construction. One form of material used is a galvanized steel. Other suitable materials can be used including composites, plastics and ceramics. The male section front seat 412 is a forwardly protruding notch and mates with a female section front recess 438 located in the female section. Similarly, the seats 410 of the male section mate with a female section rear recess 432 which have been bored out of the female section body to provide for back seating support. At the bottom face of the male section body 422 is a bullet catch 406. Bullet catch in this embodiment is bored into the bottom wall 428 of the male section coupling 402. The bullet catch 406 has a positive spring component 416, which forces a bearing 414 vertically outwards. The bearing 414 will recess and mate with a bullet socket 408 which is bored into the female section bottom wall 434. Bearing 414 provides some horizontal resistance as previously discussed in the embodiment shown through FIGS. 6 and 10, as well as providing some vertical seating alignment force between the seat top face 440 and the recess top face 442. This vertical seating alignment force is also provided somewhat at the front seat of the male section and front seat recess 438 of the female section.

Figure 10:
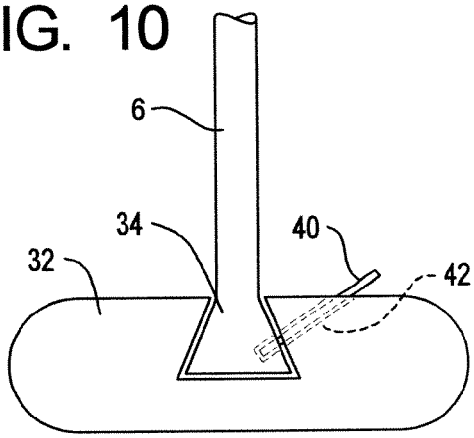
FIG. 10 is a cross-sectional view of the dovetail or tongue and groove quick release coupling mechanism showing fixation pin.

Referring to FIG. 10, an alternative embodiment is shown without the use of a bullet catch coupling mechanism 14 that instead uses a fixation pin 40. The fixation pin 40 is inserted in an angular position through the female lower body 32 and into the male upper body 34 through an angularly positioned shaft 42. Thus, during play of the drum, the vibrations and movement of the drum will not disengage the female lower body 32 from the male upper body 34 and keep the two bodies from moving in the longitudinally translational direction as well as the vertical direction. The user can then remove the fixation pin 40 from the pin shaft 42 and slide the lower body 32 from the upper body 34 disengaging the snare wire set 4 and allowing the drum head to be changed.

Figure 10A:
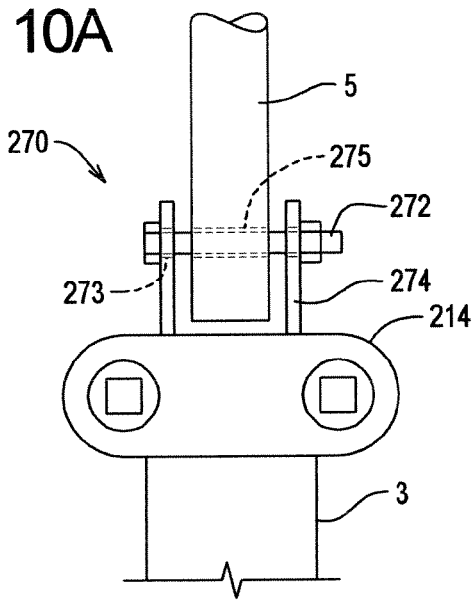
FIG. 10A is a cross-sectional view of the transverse through shaft quick release coupling mechanism.

In addition to the tongue and groove alternative embodiment as discussed in FIGS. 6-10, the quick release coupling mechanism can also be embodied through the use of a simple transverse through shaft and collar coupling mechanism. Referring to FIG. 10A, a transverse through shaft quick release coupling mechanism 270 is shown. The connecting shaft as previously discussed extends down into an interior region of a collar connection 274. The collar 274 has through ports 273 which enable a transversely aligned through shaft 272 to extend through the openings in the collar 274 and through a prearranged connecting shaft cylindrical opening 275 to create what is essentially a pin-type connection. Thus the translational vertical force for straining the cords is transferred from the connecting shaft down through the transverse through shaft 272 into the body 214 and then to the snare cord 3. The user can easily disconnect or decouple the body 214 from the guide pin 5, and reattach it without losing the previously set strain amounts.

Figure 11:
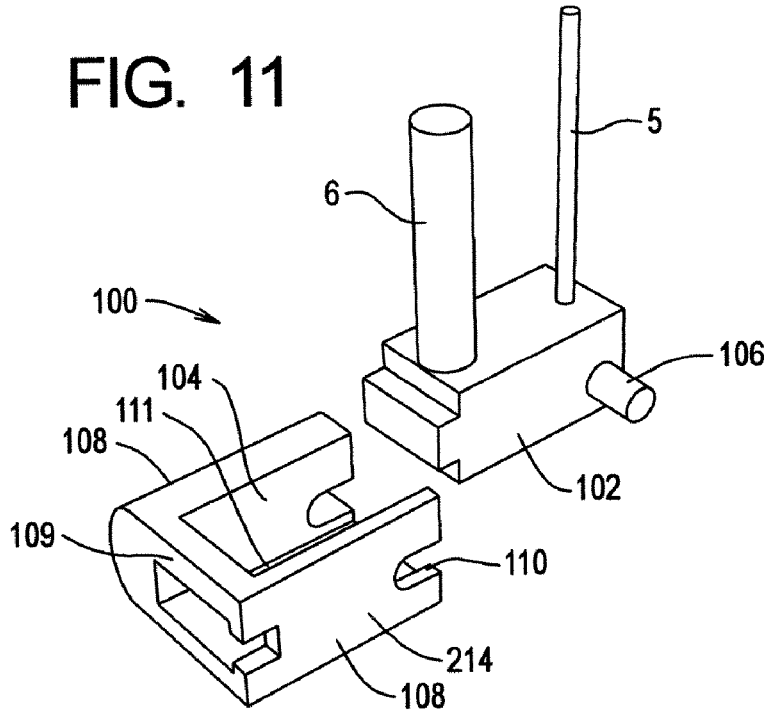
FIG. 11 is a perspective view of an alternative embodiment of the coupling mechanism.
Figure 11A:
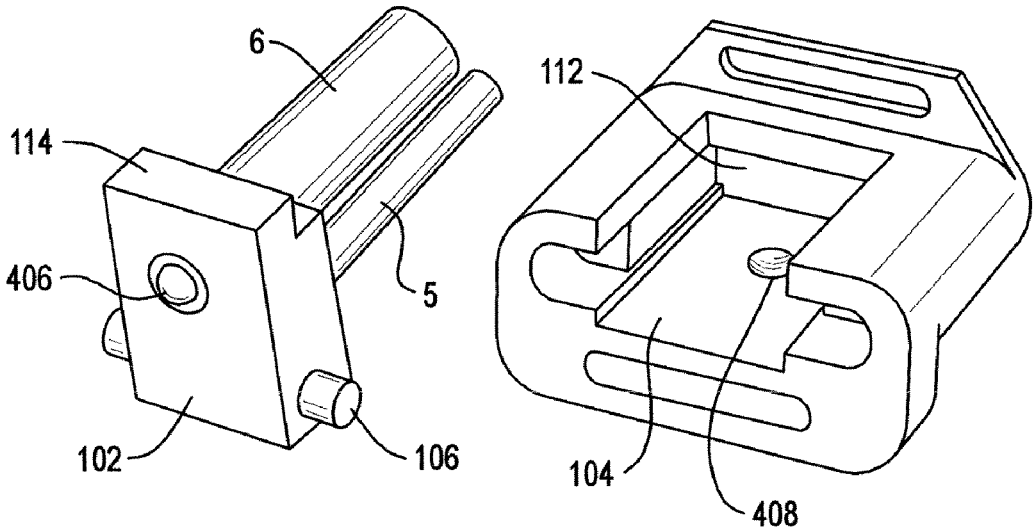
FIG. 11A is a perspective view of an alternative embodiment of the coupling mechanism.
Figure 11B:
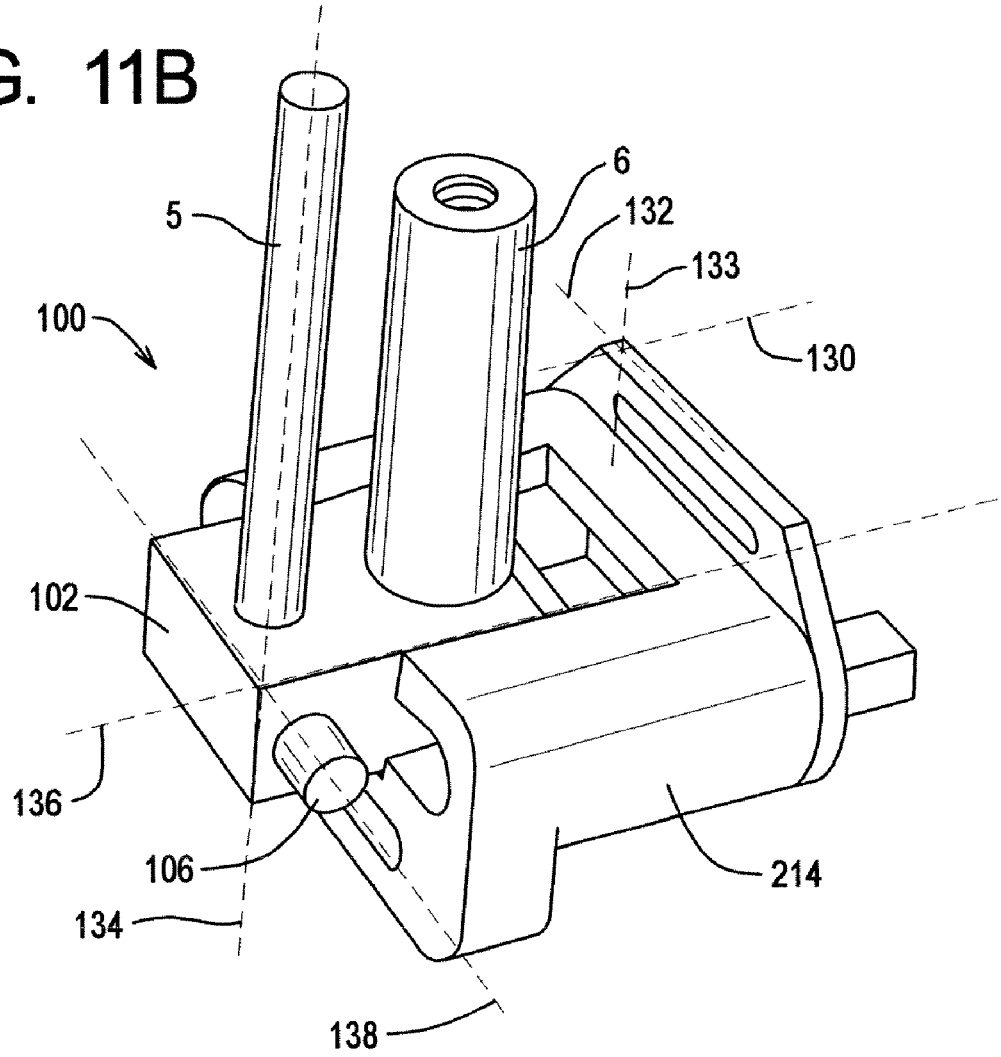
FIG. 11B is a perspective view of an alternative embodiment of the coupling mechanism.
Figure 12:
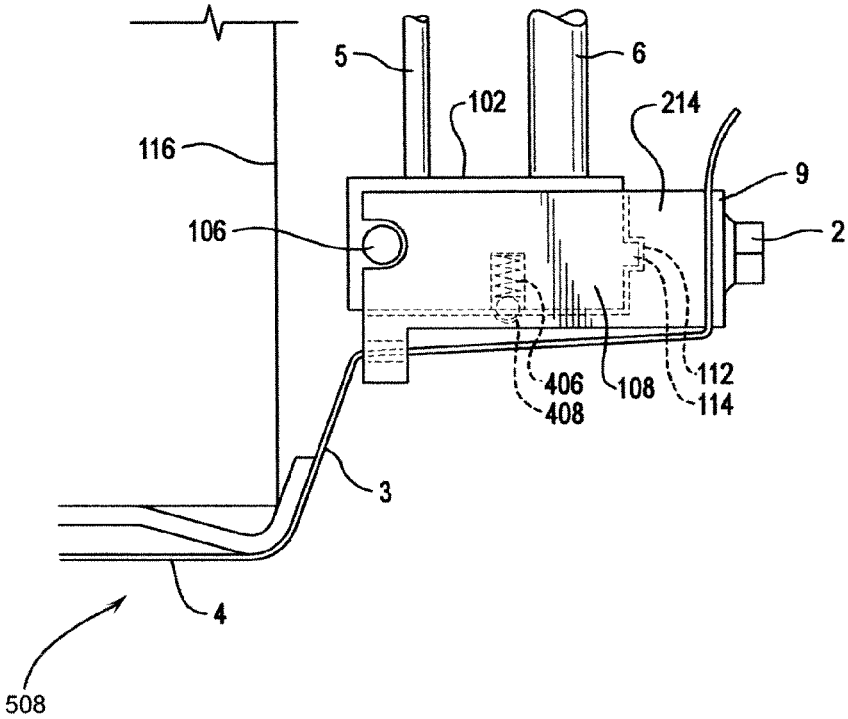
FIG. 12 is a cross-sectional view of the slotted hinge and locking lever coupling system in its coupled position.
Figure 13:
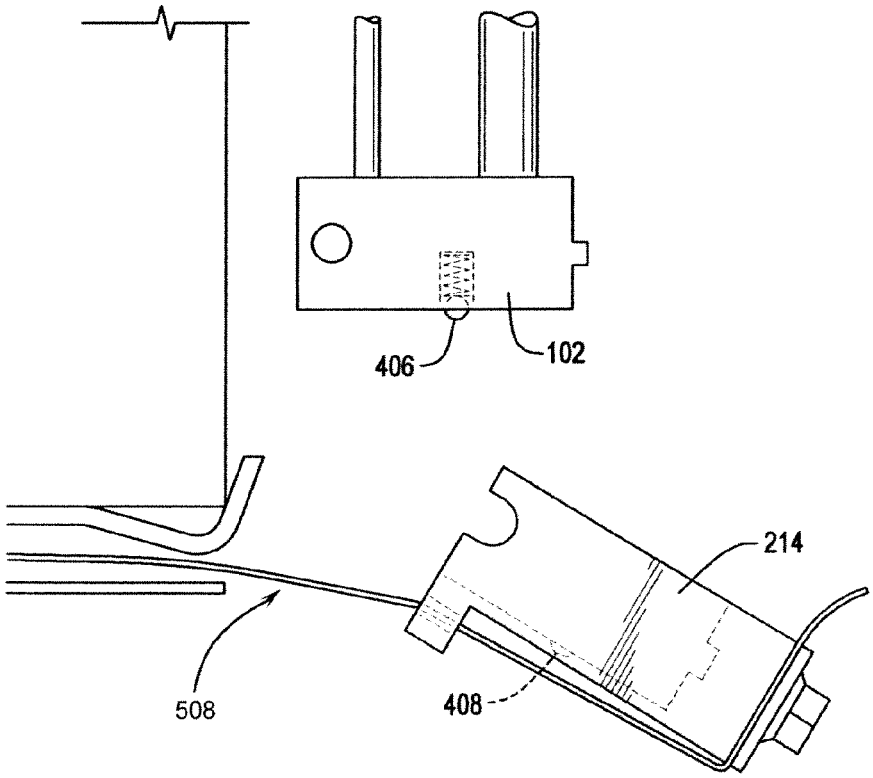
FIG. 13 is a cross-sectional view of the slotted hinge and locking lever or coupling system in its decoupled position.

An alternative embodiment includes a slotted hinge and locking lever coupling system 100 as seen in FIGS. 11-13. In this particular quick release coupling mechanism, the snare connection body 214 interfaces with a base block 102 which is permanently affixed to the connecting shaft 6 and the guide pin 5 of the main snare strainer body 7 as previously discussed. The base block 102 has a tangentially aligned stationery cylindrical shaft 106 which extends tangentially from the main body of the base block 102. The body 214 has a seat 104 which is defined by two parallel but opposite longitudinal sidewalls 108, as well as a front wall 109 and a bottom wall 111. At the ends of the longitudinal sidewalls 108 are positioned substantially mid-height of the walls, slotted hinge seats 110. The slotted hinge seats 110 are open ended and enable the user to slide the female section body 214 over the cylindrical shafts 106. Referring to FIG. 12, the snare tensioning cord 3, when strained to its desired capacity, applies a horizontal and vertical force component to the cylindrical shaft 106. This shaft transfers the vertical strain from the connecting shaft 6 in the base block 102 into the cylindrical shaft 106 down through the longitudinal sidewalls 108 and into the snare tensioning cord 3 which then tensions the drum snare 4. To engage or couple and disengage or decouple and to hold in place the snare connection body 214, two support locations are required. The majority of the load for tensioning is transferred through the shaft 106, and the remainder of the load is transferred through the male/female vertical catch. This catch is composed of a male catch or forward protruding seat 114 which extends radially forward from the front face of the base block 102 and is substantially rectilinear in shape. The female recess catch 112 is positioned to interface with the male catch 114 and is contained within the front wall 109 of the female body 214. A small amount of horizontal force due to the angular resultant tensioning force in the snare tensioning cord 3 is pulled against the body 214 and holds the male catch 114 and the female receiving or recess catch 112 in place. Further, the potential for longitudinal sliding between the male section or base block 102 and the female section or body 214 is reduced through the use of a centrally aligned bullet catch 406 positioned within the main body of the male section 102. This bullet catch 406 interfaces with a bullet catch socket 408 within the bottom wall seat 111 of the female section body 214.

To disengage the body 214 from the base block 102, the user has just to apply a vertical force greater than the frictional resistance of the male/female catch, to the top face of the body 214, thus the body 214 rotates at an angular direction about the origin of the shaft 106. The user can then pull the body 214 away from the shaft 106 and disengage (as shown in FIG. 13) the body 214 from the base block 102. The user can then perform the desired cleaning and/or maintenance operations of the drum head as previously discussed.

I claim:

1. A coupling system, operatively configured to removably couple a snare wire set of a snare drum to a modified snare strainer of the snare drum, the coupling system comprising:

a. a first end coupling mechanism for releasing a first end of the of the snare wire set from the snare drum, the first end coupling mechanism comprising;

i. a first end clamping body having a first portion and a second portion;

the first portion of the first end clamping body configured to be removably attached to the first end of the snare wire set;

the second portion of the first end clamping body configured to be removably attached to the modified snare drum strainer, the second portion comprising a quick release mechanism configured to removably couple the second portion to the first portion where the first end clamp body is configured to be positioned tangentially outwardly from the snare drum and then the first portion is configured to be repositioned downwardly to remove the first end coupling mechanism from the snare drum, ii. a user operated release trigger operatively configured to engage the quick release mechanism, whereby the release trigger has a first position effectively coupling the first portion of the first end clamping body to the second portion, and a second position effectively detaching the first portion of the first end clamping body from the second portion, and iii. wherein detaching the first portion of the first end clamping body from the second portion effectively releases the first end of the of the snare wire set from the snare drum for removal or replacement b. a connecting shaft extending from the snare drum strainer and operatively configured to engage the snare connection body;

c. a guide pin extending from the snare connection body and operably configured to engage a recess in the snare drum strainer, and d. wherein the connecting shaft and the guide pin are substantially parallel to each other.

2. The coupling system of claim 1 wherein the release trigger comprises a spring-loaded button configured to engage a connecting shaft of the modified snare drum strainer and facilitate removal and replacement of the snare without re-adjusting tension of the snare and without tools.

3. The coupling system of claim 1 wherein the second portion of the first end clamping body comprises a plurality of key screws which are configured to facilitate attachment of the first portion of the first end clamping body to the first end of the snare wire set.

4. The coupling system of claim 1 wherein the quick release mechanism is operatively configured to detach the snare wire set from the snare strainer without the use of tools and quickly reattach to re-establish the preset strain of the snare without adjusting the snare drum strainer.

5. The coupling system of claim 1 further comprising:

a. a second end coupling mechanism configured to removably couple a second end of the snare of the snare drum to a wall of the snare drum comprising:

i. a second end clamping body having a first section and a second section;

the first section of the second end clamping body configured to attach to a snare drum wall;

the second section having a first portion comprising a quick release mechanism configured to couple to the first section, and a second portion configured to removably couple to the snare of a snare drum; and ii. wherein the quick release mechanism is configured to facilitate removal and replacement of the snare quickly and without tools.

6. The coupling system of claim 1 further comprising a clamping plate removably coupled to a snare connection body and secured by at least one key screw.

7. A coupling system configured to removably couple a snare wire set of a snare drum comprising:

a. an end clamping body configured to removably couple an end of the snare wire set to a snare drum wall, the clamping body having a first section and a second section;

i. the first section of the second end clamping body configured to attach to a snare drum wall;

ii. the second section having a first portion comprising a quick release mechanism configured to couple to the first section, and a second portion configured to removably couple to the wire set of a snare drum;

b. a release trigger operatively configured to engage the quick release mechanism and facilitate the release of the first section of the second end clamping body from the second section;

c. wherein there is no tensioning mechanism between the first section of the second end clamping body and the snare drum wall; and d. wherein the quick release mechanism is configured to facilitate removal and replacement of the wire set quickly and without tools e. wherein a force is required by a user in a direction substantially parallel to a long axis of the snare drum wire set and radially outward from the snare drum releases the first section from the second section;

f. wherein the quick release mechanism further comprises at least one hinge shaft which extends substantially at a right angle to the direction of engagement between the first and second portions, the shaft extending from the second portion and is slidably received by at least one hinge seat formed on the first portion.

8. The coupling system of claim 7 wherein the release trigger comprises a spring-loaded button configured to engage a portion of the modified snare drum strainer and facilitate removal and replacement of the wire set quickly and without tools.

9. The coupling system of claim 7 wherein the release trigger comprises a bullet catch wherein the bullet catch further comprises:

a. a substantially cylindrical keeper;

b. a captive ball capable of restricted linear movement within the keeper;

c. a compression member within the keeper biasing the captive ball toward one end of the keeper; and d. a socket which is operatively configured to receive a portion of the captive ball and maintain the first section in proximity to the second section forming at least a portion of the quick release mechanism.

10. A quick-disconnect coupling system comprising:

a. a clamping body configured to couple to an end of a snare of a snare drum;

b. a connecting shaft having a first end and a second end, configured to releasably couple the clamping body to a snare drum strainer;

i. wherein the first end of the connecting shaft is operatively configured to be coupled to the clamping body using a quick disconnect mechanism;

ii. wherein the quick disconnect mechanism operates without a multi-turn threaded mechanism;

iii. wherein the second end of the connecting shaft is operatively configured to be coupled to a strainer of a snare drum; and c. the quick-disconnect mechanism comprises a release trigger configured to engage a catch on the connecting shaft and maintain position of the clamping body in relation to the snare drum strainer and release the clamping body from the snare drum strainer when engaged.

11. The quick-disconnect coupling system of claim 10 further comprising a guide pin having a first end and a second end configured to engage the clamping body on the first end and the snare drum strainer on the second end, the guide pin configured to substantially prohibit rotation of the clamping body in relation to the snare drum strainer.

12. The quick-disconnect coupling system of claim 10 wherein the connecting shaft is substantially cylindrical.

13. The quick-disconnect coupling system of claim 10 wherein the connecting shaft is coaxial with an adjustable circumferential shaft of the snare drum strainer.

14. The quick-disconnect coupling system of claim 10 wherein the quick-disconnect mechanism can be operated without tools.

15. A coupling system for removably coupling a snare drum wire set to a snare drum strainer, the coupling system comprising:

a. a base block comprising a forward seat, the base block operatively configured to couple to a snare drum strainer;

b. a snare connection body comprising a rearward seat configured to removably engage the forward seat of the base block the snare connection body configured to removably couple to a first end of a snare drum wire set c. the coupling system configured to allow separation of the base block from the snare connection body when the forward seat of the base block is removed from the seat in the snare connection body;

d. the coupling system further comprising e. a connecting shaft extending from the snare drum strainer and operatively configured to engage the snare connection body;

f. a guide pin extending from the snare connection body and operably configured to engage a recess in the snare drum strainer, and g. wherein the connecting shaft and the guide pin are substantially parallel to each other.

16. The coupling system of claim 15 wherein the snare drum strainer comprises a snare drum throw off.

17. The coupling system of claim 15 further comprising a clamping plate removably coupled to the snare connection body, the clamping plate secured by at least one key screw to the snare connection body.

18. The coupling system of claim 15 further comprising at least one shaft extending laterally from the base block and configured to removably engage a recess in the snare connection body.

19. The coupling system of claim 18 wherein the laterally extending shaft is substantially cylindrical.

20. The coupling system of claim 15 further comprising a bullet catch configured to interoperate with a bullet catch socket to hinder release of the base block from the snare connection body until a force is exerted between the base block and the snare connection body significant enough to overcome the hindering force of the coupling system wherein the bullet catch further comprises;

i. a substantially cylindrical keeper;

ii. a captive ball capable of restricted linear movement within the keeper;

iii. a compression member within the keeper biasing the captive ball toward one end of the keeper; and iv. a socket which is operatively configured to receive a portion of the captive ball and maintain the bullet catch in proximity to the bullet catch socket.

21. The coupling system of claim 20 wherein the bullet catch extends from the base block and the bullet catch socket is provided in the snare connection body.

22. The coupler system of claim 15 further comprising:

a. a male section secured to the wall of the snare drum;

b. the male section further comprising a front seat;

c. a female section configured to couple to a second end of the snare drum wire set;

d. the female section comprising a rearward seat configured to removably engage the front seat of the male section; and e. wherein the front seat of the male section and the rearward seat of the female section interoperate as two elements of a quick release mechanism.

23. The coupling system of claim 22 further comprising a bullet catch configured to interoperate with a bullet catch socket to substantially limit movement of the male section in relation to the female section.

24. A snare drum quick release coupler system for removably coupling a snare drum wire set to a snare drum wall, the coupler system comprising:

a. a male section secured to the wall of the snare drum;

b. the male section further comprising a front seat;

c. a female section configured to removably couple to the male section and removably couple to the snare drum wire set;

d. the female section comprising a rearward seat configured to removably engage the front seat of the male section and facilitate the release of the female section from the male section;

e. wherein sufficient force exerted by the user directly upon the female section in a direction substantially parallel to a long axis of the snare drum wire set and radially outward from the snare drum releases the quick release coupler system thus releases the female section from the male section; and f. wherein the front seat of the male section and the rearward seat of the female section interoperate as two elements of a quick release mechanism operatively configured to removably release the wire set from the snare drum for removal or replacement.

25. The coupling system of claim 24 further comprising a clamping plate removably coupled to the female section and secured by at least one key screw.

26. The coupling system of claim 24 further comprising at least one sliding shaft extending laterally from the male section and configured to removably engage a recess in the female section.

27. The coupling system of claim 26 further comprising a bullet catch configured to interoperate with a bullet catch socket to substantially limit movement of the male section in relation to the female section.

28. A snare drum coupler system for removably coupling a snare drum wire set to a snare drum throw or to a snare drum outer wall, the coupler system comprising:

a. a first portion coupled to a snare drum throw, or alternatively coupled to a snare drum outer wall without a snare drum throw;

b. a second portion removably coupled to the first portion, and removably coupled to a snare drum wire set;

c. a quick release mechanism configured to separably remove the first portion from the second portion which thus releases at least one end of the wire set from the snare drum for removal or replacement; and d. wherein the quick release mechanism further comprises at least one hinge shaft which extends substantially at a right angle to the direction of engagement between the first and second portions, the shaft extending from the second portion and is slidably received by at least one hinge seat formed on the first portion.

29. The snare drum coupler system of claim 28 wherein the release mechanism further comprises a user engagement portion wherein force exerted upon the user engagement portion releases the first portion from the second portion.

30. A snare wire set attachment system configured to attach a snare wire, having a first and second end, to a snare drum, having first and second attachment locations, the snare wire attachment system comprising:

a. a male coupling section, having a back wall configured to fixedly attach to the first attachment location of the snare drum, the male coupling section provided with a radially extending seat and further comprising a front seat that is positioned radially outward from the radially extending seat;

b. a female coupling section comprising a wing recess, having a recess top wall configured to engage the radially extending seat of the male coupling section, the female coupling section further comprising a front recess configured to engage the front seat of the male coupling section;

c. the female coupling section comprising a clamping region configured to rigidly attach to the first end of the snare wire;

d. whereas the female coupling section is configured to be orientated in a locked position with the male coupling section, where the radially extending seat is in engagement with the wing recess, where the recess top wall exerts pressure upon the radially extending seat, and further, the front seat is in engagement with the front recess, e. whereas to disengage the female coupling section from the male coupling section the female coupling section is repositioned in a radially outward direction from the snare drum, and the front recess is configured to first disengage from the front seat while the recess top wall is still in engagement with the radially extending seat of the male coupling section, thereby further repositioning the female coupling section radially outward relative to the drum section thereafter disengaging the wing recess of the female coupling section from the radially extending seat of the male coupling section.

31. A snare wire set attachment system as recited in claim 30, where the male coupling section has a bullet catch configured to engage a bullet socket of the female coupling section when the female coupling section is in the locked position with the male coupling section.

32. A snare wire set attachment system as recited in claim 30, where the front seat is comprised of an upper surface that engages an upper surface of the front recess, and the degree of engagement therebetween in the tangential direction is less than the degree of engagement between the recess top wall and an upper surface of the tangentially extending seat in the tangential direction.

33. A snare wire set attachment system as recited in claim 30, where a cord clapping plate operates as the clamping section, where the cord is the first attachment location of the snare wire set.

* * * * *